US006206493B1

(12) United States Patent
Sanchez-Levin et al.

(10) Patent No.: US 6,206,493 B1
(45) Date of Patent: Mar. 27, 2001

(54) DISPLAY STRUCTURE FOR COLLECTIBLES

(75) Inventors: Vilma Sanchez-Levin, Coral Gables, FL (US); Kenneth Curtis, Little Neck, NY (US)

(73) Assignee: Collector's Museum, LLC, Coral Gables, FL (US)

( * ) Notice: Subject to any disclaimer, the term of this patent is extended or adjusted under 35 U.S.C. 154(b) by 0 days.

(21) Appl. No.: 09/359,093

(22) Filed: Jul. 22, 1999

(51) Int. Cl.[7] ..... A47F 5/05

(52) U.S. Cl. ..... 312/125; 312/249.2; 211/78; 211/131.1

(58) Field of Search ..... 312/249.2, 249.6, 312/249.7, 125; 211/78, 131.1, 167; 206/504, 776, 778; 220/23.4, 23.6, 23.83, 23.86

(56) References Cited

U.S. PATENT DOCUMENTS

| | | | | |
|---|---|---|---|---|
| 256,181 | * | 4/1882 | Westphal | 312/249.2 X |
| 585,360 | | 6/1897 | Jordan . | |
| 788,459 | | 4/1905 | Ferle et al. . | |
| 1,019,384 | | 3/1912 | Walz . | |
| 1,283,518 | | 11/1918 | Hormes . | |
| 1,755,477 | * | 4/1930 | Hunyady | 211/131.1 X |
| 1,929,677 | * | 10/1933 | Davis | 312/249.2 X |
| 2,887,232 | | 5/1959 | Winter, Jr. . | |
| 2,964,201 | | 12/1960 | Huffman . | |
| 3,957,159 | * | 5/1976 | Radek | 211/78 X |
| 4,005,775 | | 2/1977 | Crosslen . | |
| 4,014,437 | | 3/1977 | Rumble et al. . | |
| 4,030,608 | | 6/1977 | Howard . | |
| 4,073,557 | | 2/1978 | Crosslen . | |
| 4,126,366 | * | 11/1978 | Handler et al. | 211/163 X |
| 4,653,649 | | 3/1987 | Holdredge, Jr. . | |
| 4,673,090 | | 6/1987 | Crosslen . | |
| 5,031,779 | | 7/1991 | Szenay et al. . | |
| 5,033,626 | * | 7/1991 | Platti | 211/78 X |
| 6,016,927 | * | 1/2000 | Krupp | 211/131.1 X |

FOREIGN PATENT DOCUMENTS

| | | | | |
|---|---|---|---|---|
| 2229084 | * | 9/1990 | (GB) | 312/249.6 X |
| 488584 | * | 9/1990 | (IT) | 211/131.1 X |

* cited by examiner

*Primary Examiner*—Peter R. Brown
*Assistant Examiner*—Michael J. Fisher
(74) *Attorney, Agent, or Firm*—Cobrin & Gittes

(57) ABSTRACT

A modular display structure that has a base and a transparent cover. The base and cover may separate to allow insertion of a collectible and may then join to close them and contain the collectible. The base and cover cooperate to define a top, a bottom and sides. A stationary display structure has a column sandwiched between two compartment holders. Each holder is wider than the column and defines partitions spaced apart from each other. The partitions on one holder are in registry with counterparts in the other holder. The modular display structure may be inserted between any pair of neighboring partitions of both holders that are in registry and then snapped into place. The stationary display structure may have levels of compartment holders spaced apart by respective columns, thereby permitting stacking.

27 Claims, 6 Drawing Sheets

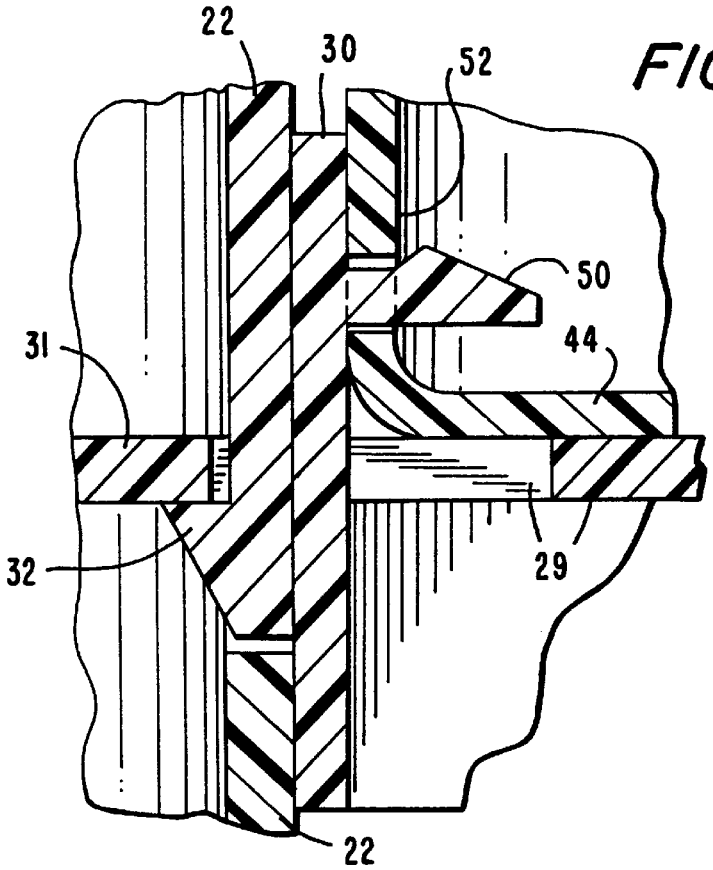
FIG. 5
FIG. 6
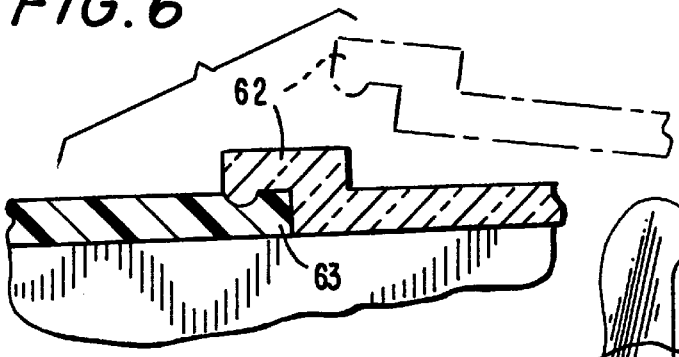
FIG. 7
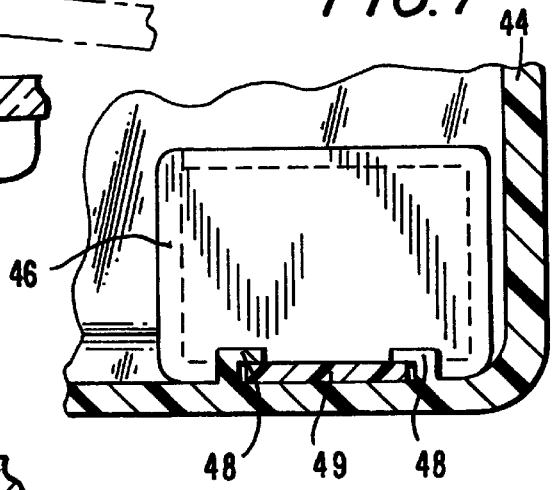
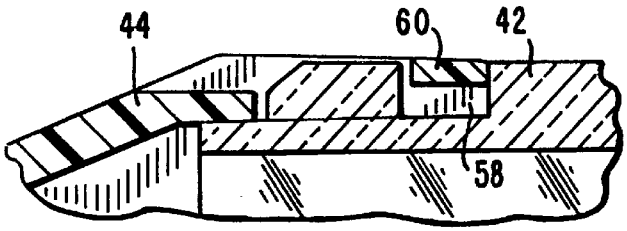
FIG. 8

DISPLAY STRUCTURE FOR COLLECTIBLES

CROSS-REFERENCE TO RELATED PATENT APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention relates to a point of purchase display case and display modules for use in the home. Collectibles, such as stuffed animals, dolls, miniatures or toys may be housed within the display case.

2. Discussion of Related Art

Point of purchase display cases and merchandise racks for use in commercial establishments are well known. Since they are designed for commercial use, they are generally not found in the home.

Collectibles have become increasingly popular as the current BEANIE BABIES craze has shown, which has created a need for owners to store their collectibles in the home. In addition to mere storage, owners want their collectibles displayed for their enjoyment and for show to others. Further, in addition to storage and display, the owners may want contamination of their collectibles minimized. A display case or merchandise rack would fulfill these objectives, but it must be designed for use in the home to meet commercial acceptance by individual collectible owners.

BRIEF SUMMARY OF THE INVENTION

One aspect of the invention resides in a modular display structure that has a base and a transparent cover. The base and cover may separate to allow insertion of a collectible and may then join to close them and contain the collectible. The base and cover cooperate to define a top, a bottom and sides.

Another aspect of the invention resides in a stationary display structure having a column sandwiched between two compartment holders. Each holder is wider than the column and defines partitions spaced apart from each other. The partitions on one holder are in registry with counterparts in the other holder. The modular display structure may be inserted between any pair of neighboring partitions of both holders that are in registry and then snapped into place.

A base may be provided beneath a lower one of the holders and either a top is placed on the upper one of the holders or additional stacking is effected with further columns and holders such that the columns are in alignment with each other and thus the holders are each in alignment with each other.

BRIEF DESCRIPTION OF THE SEVERAL VIEWS OF THE DRAWING

For a better understanding of the present invention, reference is made to the following description and accompanying drawings, while the scope of the invention is set forth in the appended claims.

FIG. 5 is a cross-section across 5—5 of FIG. 3.

FIG. 6 is a cross-section across 6—6 of FIG. 3.

FIG. 7 is a cross-section across 7—7 of FIG. 3.

FIG. 8 is a cross-section across 8—8 of FIG. 4.

DETAILED DESCRIPTION OF THE INVENTION

Figure 1:
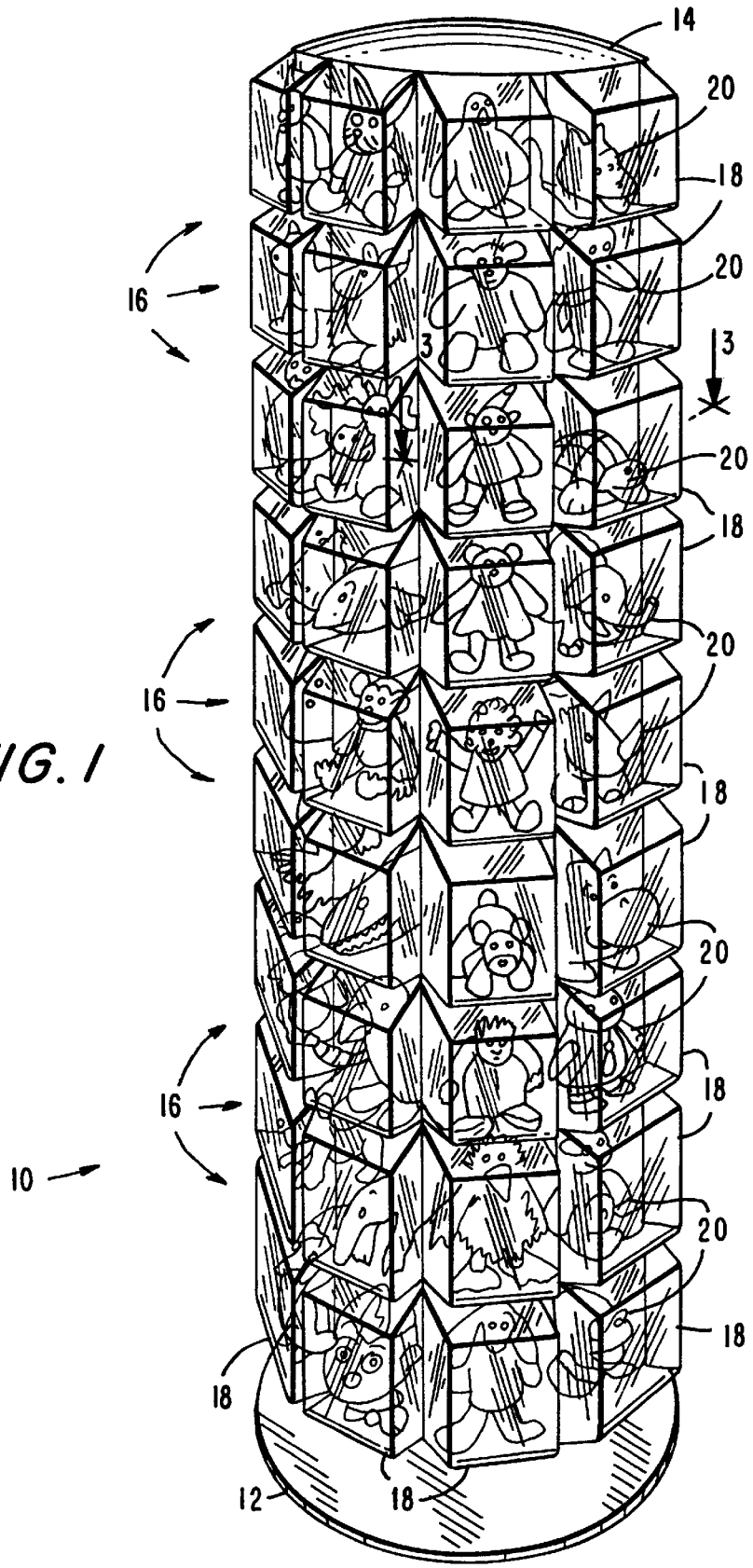
FIG. 1 is a perspective view of a display structure in accordance with the invention and showing storage of collectibles.

Turning to the drawing, FIG. 1 shows a stationary display structure 10 that includes a stand 12, a lid 14 and nine levels 16 stacked one atop the other. Each level 16 has a plurality of modular display structures 18 snapped into retention position. Each modular display structure 18 is shown storing a collectible 20, such as a doll or stuffed animal character.

Figure 2:
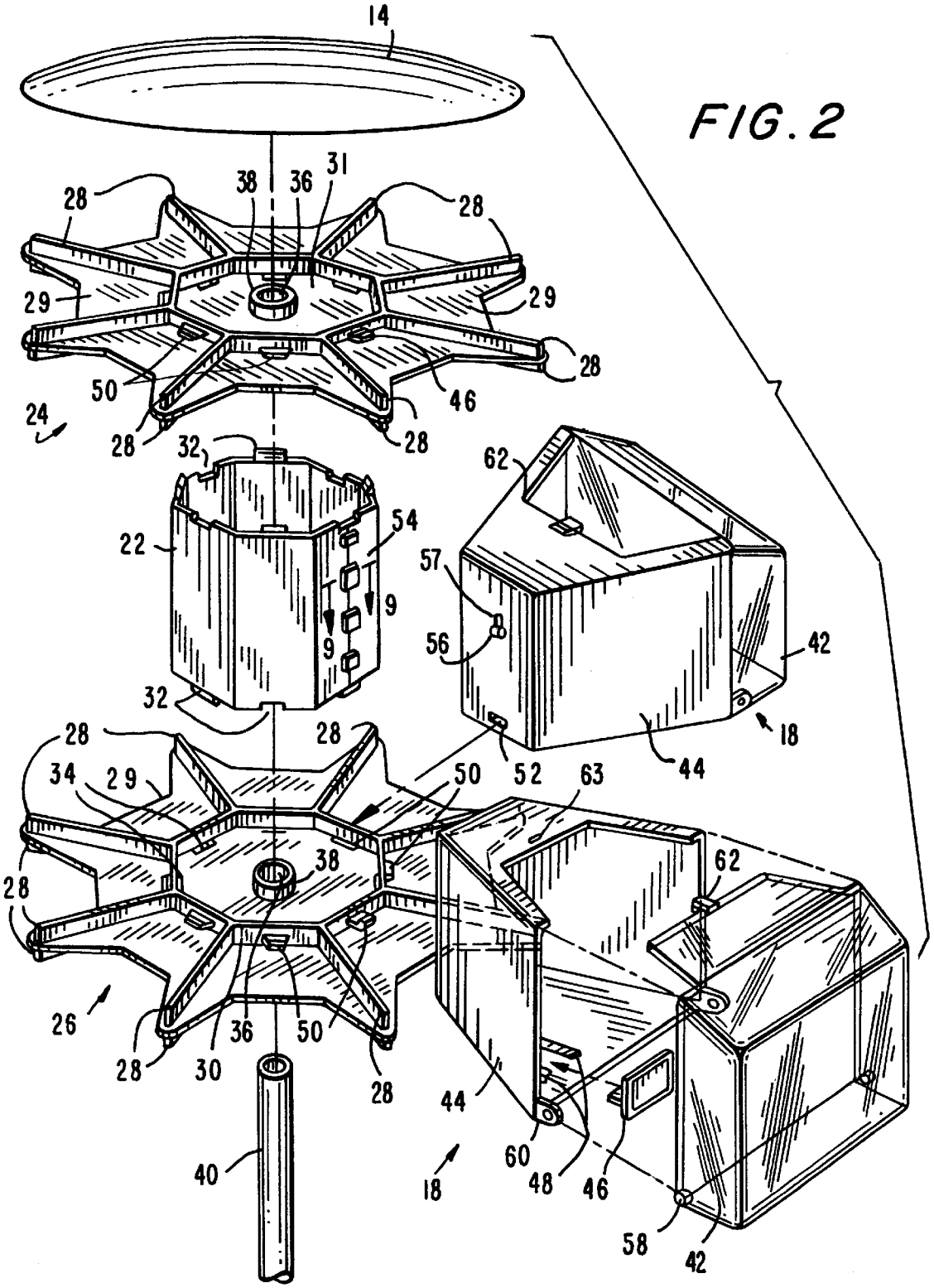
FIG. 2 is an exploded view showing assembly of the top level of the display structure of FIG. 1.

FIG. 2 shows the uppermost level 16 of FIG. 1 as an exploded view. There is the lid 14 that is dome-shaped and a tubular column 22 sandwiched between two holders 24, 26, each holder having partitions 28 that extend in radial directions from wall segments 30. Each wall segment 30 extends between ends of a respective two neighboring ones of the partitions 28. A support plate 29 is bounded by the wall segment 30 and the neighboring ones of the partitions 28. A further support plate 31 is bounded on its outer periphery by the wall segments 30.

Both the tubular column 22 and two holders 24, 26 are configured to mate with each other in a complementary manner. The tubular column 22 has the shape of a cylindrical octagon. The wall segments 30 of each holder 24, 26 together define an octagon. Each end of the tubular column 22 has engaging connections 32 formed as alternating recesses and projections that mate with their counterparts 34 on the holders 24, 26 such that the ends of the tubular column are radially inward of octagon shape defined by the wall segments 30.

There are eight partitions 28 on each side arranged so that a partition on one side is in alignment with its counterpart on the other side. Each holder 26 has a central tubular opening 36 passing centrally through the further support plate 31 and being defined by protruding rings 38.

A tube 40 is inserted through the tubular openings 36 of each holder and through the hollow of the column 22 to add further stability to the overall display structure. This tube may extend the full length of the display structure 10 of FIG. 1.

Also shown are modular display structures 18, each including a transparent cover 42 and an opaque base 44. A sign holder 46 has a support 49 that may be slid between L-shaped tracks 48 (see FIG. 7) into position on the interior bottom of the base 44, while the cover 42 and base 44 are separated from each other. The walls of the base 44 converge in a direction away from where the cover 42 is connected to the base 44 so as to fit between any neighboring pairs of the partitions 28 that converge toward the wall segments 30 in a like manner.

Each wall segment 30 has a catch component 50 and the base 44 has a catch component 52 that may engage each other to allow the modular display structure 18 to snap into position on the holder 26. Also, the column 22 has a catch component 54 and the rear of the base 44 of the modular display has a catch component 56 that engage each other. The catch component 56 is secured in place within a keyhole knockout 57.

The modular display structure 18 fastens the cover 42 and base 44 through a hinged connection that includes an outward protrusion 58 and an accommodating opening in a hinge 60. The hinged connection is found at either side of the modular display structure 18. In addition, a clasp connection 62 is provided to mate with a recess connection 63 of the base 44.

Figure 3:
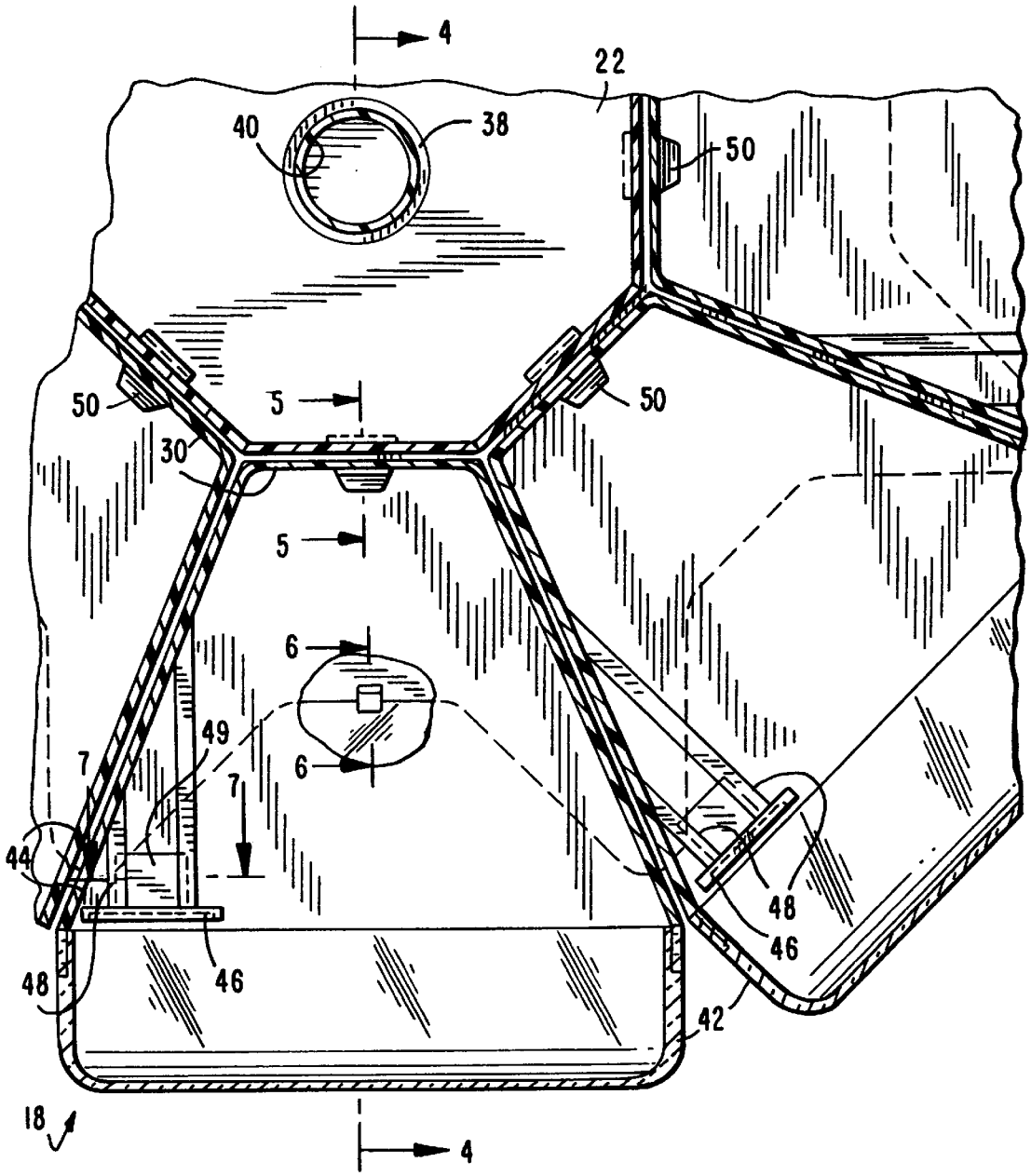
FIG. 3 is a cross-section across 3—3 of FIG. 1.
Figure 4:
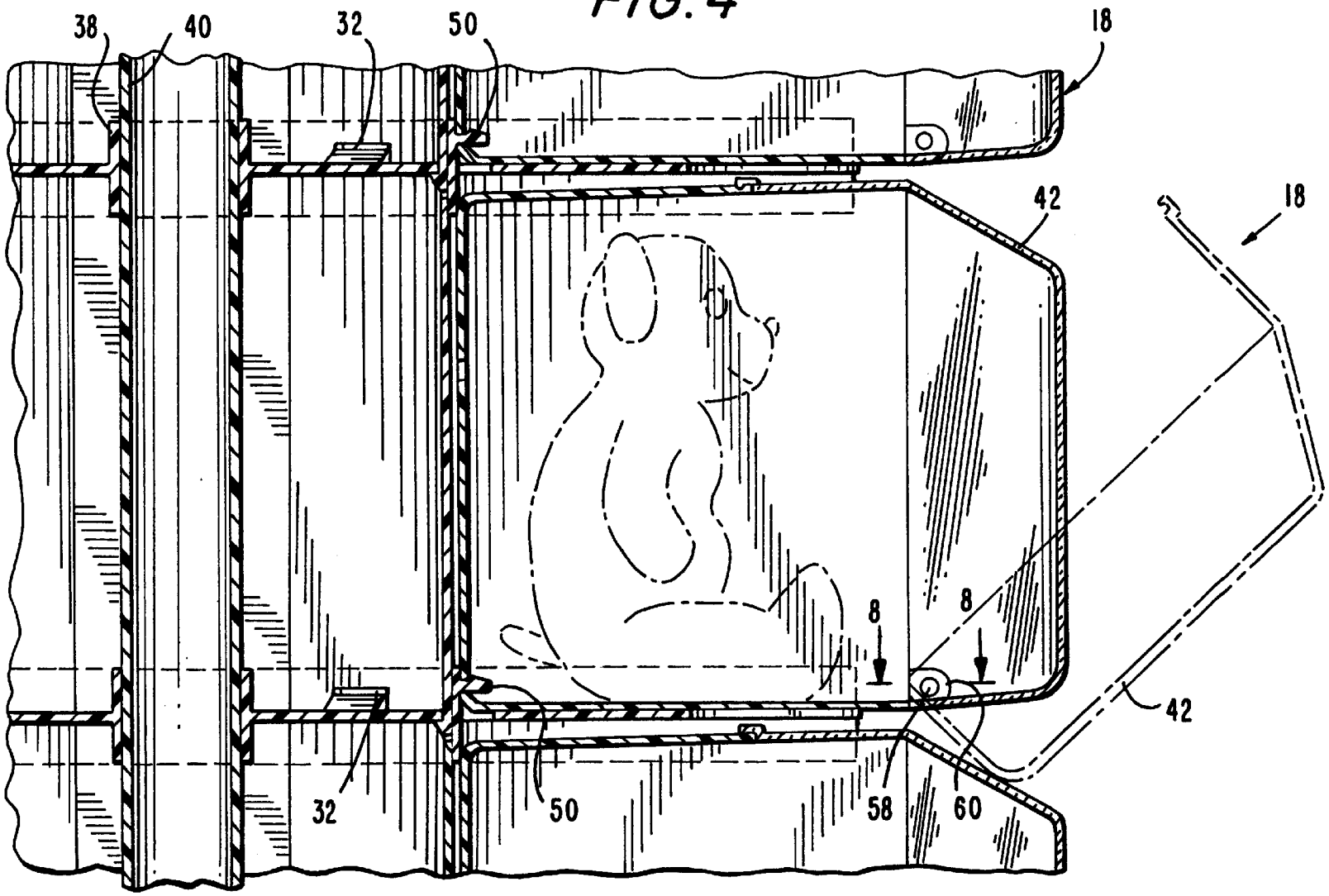
FIG. 4 is a cross-section across 4—4 of FIG. 3.
Figure 9:
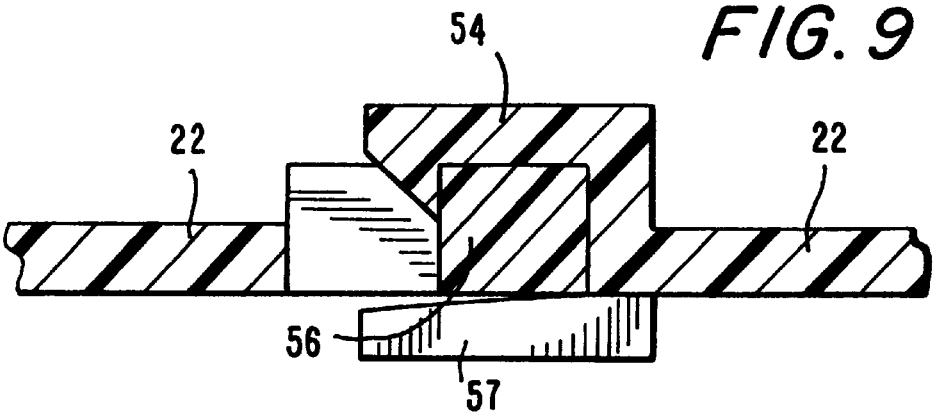
FIG. 9 is a cross-section across 9—9 of FIG. 2.

Turning to FIG. 3, the snapped-in position of the modular display structures 18 is shown relative to the column 22. FIG. 4 shows the manner in which the cover 42 is swung from a closed position to an open position via the hinged connections. The upper portion of the cover is angled to facilitate insertion of one's hand to grasp the cover so as to give clearance from its upper neighboring modular display structure 18. The engagement of the engaging connections 32 is shown as well as the insertion of the pole 40 extending between successive ones of the rings 38. FIGS. 5–9 show the connection of various components and should be self-explanatory. The same components are also shown by reference numeral in FIG. 2.

Figure 10:
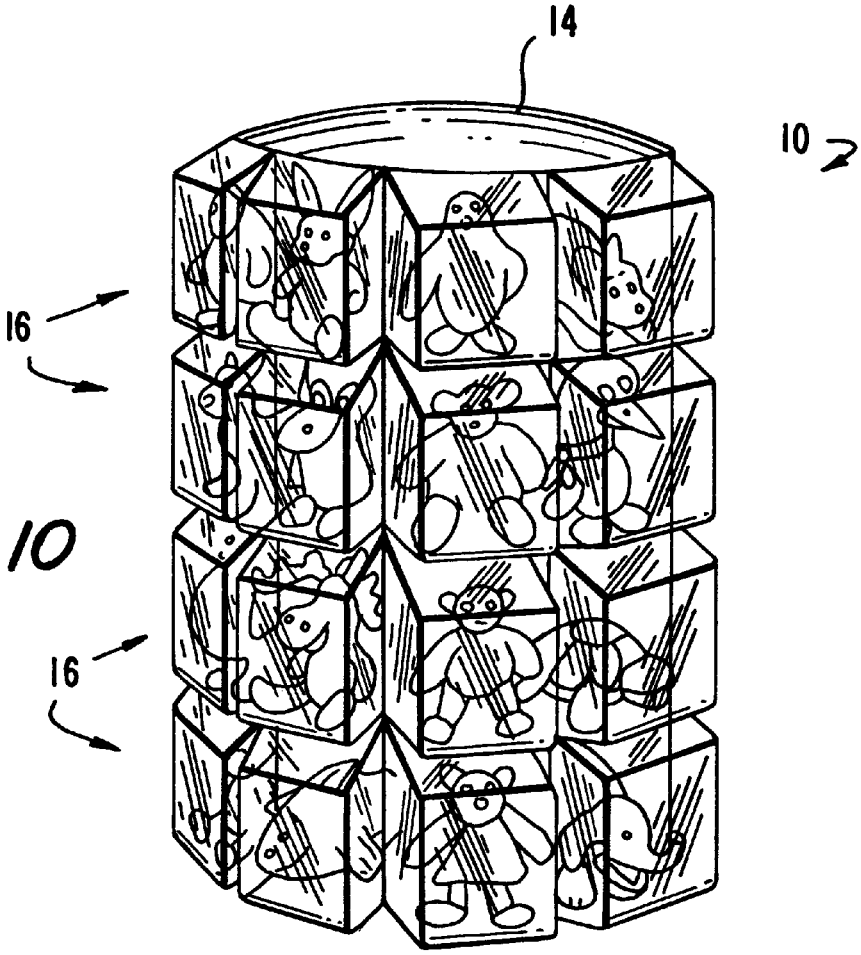
FIG. 10 is a perspective view as in FIG. 1 but for a lesser number of levels and showing storage of collectibles.

FIG. 10 shows a smaller version of the display structure 10 of FIG. 1, showing just the four top levels. The base 12 of FIG. 1 may be secured directly to the underside of the bottom level of the FIG. 10 embodiment. By stacking additional levels, the smaller version of the display structure of FIG. 10 may be increased to the size of that of FIG. 1. Thus, a user may start off with a single level, fill it up, and build up gradually. Eventually, a height is reached at about eye level that should be considered the maximum height for easy viewing. An appropriately sized pole 40 may be obtained for insertion at suitable times.

To exchange a collectible 20, the cover 42 is swung open, the existing collectible and its sign are removed and the new collectible and its sign are inserted as a replacement. Each modular display structure 18 may be pulled out by grasping the cover 42 and pulling outwardly to disengage the base 44 from the column 22 as desired. The cover may be opened by swinging open the cover 42 by disengaging its clasp connection 62. 63 and then closed once again. When done, the modular display structure 18 may be snapped back into its original position or exchanged with a different modular display structure 18.

The modular display structure 18 may instead be secured to any surface having a connection analogous to that of connection 54. In this manner, a wall plaque may be provided with such connections 54 to allow securement by the modular display structure 18.

The partitions 28 of one holder define compartments between pairs of them that are in registry with counterparts of another holder, thereby allowing the modular display structure to be snapped into position between the compartments in registry with each other.

As may be seen in FIG. 2, the sidewalls of the cover 42 and base 44 diverge from their respective closed end exterior to their respective open end interior. Thus, where the cover 42 and base 44 join, the areal dimension is greater than at either end.

Also, the peripheral of the base 44 corresponds to the periphery of the support plate 29 so the two may align when the modular display structure 18 is snapped into place.

The display structure 10 may rest on a lazy susan or other type of rotatable stand to permit the display structure 10 to rotate about its vertical axis through the pole 40. The pole 40 is preferably extended through the base 44 and received in an accommodating recess within the center of the lazy susan to provide stability. If the display structure is short enough to avoid the need for the pole, it may be placed to rest upon the top surface of the lazy susan to rotate therewith.

While the foregoing description and drawings represent the preferred embodiments of the present invention, it will be understood that various changes and modifications may be made without departing from the spirit and scope of the present invention.

What is claimed is:

1. A display structure for a collectible, comprising a base and a cover having complementary engagement members that engage each other, the base and the cover cooperating with each other to define a cavity bounded by the base and the cover, the cover having at least a portion that is transparent, the cover having a closed front, an open rear, and sidewalls, the open rear having an edge periphery that defines a larger areal dimension than is defined by an edge periphery of the closed front, the base having an open front, a closed rear, and sidewalls, the open front having an edge periphery that defines a larger areal dimension than is defined by an edge periphery of the closed rear.

2. A display structure as in claim 1, wherein the complementary engagement members include hinged connections that allow the cover to swing about the hinged connections from an open position that is disengaged from the base to a closed position that is engaged with the base.

3. A display structure as in claim 1, further comprising an upright sign holder within one of the base and the cover and secured to same.

4. A display structure as in claim 1, wherein the cover is completely transparent.

5. A display structure as in claim 1, wherein the top of the base has a recess, the top of the cover having a projection that fits into the recess in a complementary manner, the projection being transparent.

6. A display structure as in claim 1, wherein the closed rear of the base has an engaging member configured to effect engagement and snap into place with a complementary engaging member.

7. A display structure as in claim 1, wherein the sidewalls of the base converge from the open front to the closed rear.

8. A display structure as in claim 1, wherein the sidewalls of the cover converge from the open rear to the closed front.

9. A display structure as in claim 1, wherein the cover converges from the open rear to the closed front.

10. A display structure for collectibles, comprising a column, two holders sandwiching the column there between, each of the holders being wider than the column and having partitions, the partitions of one of the holders being arranged in registry with those of the other of the holders, complementary engagement members engaging each other between the column and each of the holders, and further engaging members on at least one of the column and holders for engaging with complementary ones of additional engaging members.

11. A display structure as in claim 10, wherein the partitions of each of the holders extend outwardly in a directions that diverge away from each other.

12. A display structure as in claim 11, wherein each of the holders has a surface between each of the partitions that is recessed.

13. A display structure as in claim 12, further comprising a show case in position between the holders bounded by neighboring ones of the partitions, the show case having a base with a top that has a recess, the recess in the top of the base and the recess in the surface between the neighboring ones of the partitions in the holders being in alignment with each other.

14. A display structure as in claim 10, further comprising a show case in position between the holders bounded by neighboring ones of the partitions, the show case having the complementary ones of the additional engaging members that engage with the further engaging members on at least one of the column and the holders.

15. A display structure as in claim 10, wherein each of the holders have opposite sides with the partitions on both of the opposite sides.

16. A display structure as in claim 10, wherein one of the two holders is arranged at an elevation that is higher than that of the other of the two holders, further comprising a lid atop the one of the two holders that is at the higher elevation than the other of the two holders.

17. A display structure as in claim 10, wherein one of the two holders is arranged at an elevation that is higher than that of the other of the two holders, further comprising an additional column arranged atop the one of the two holders that is at the higher elevation than the other of the two holders.

18. A display structure as in claim 10, further comprising a modular display structure in position between the holders bounded by neighboring ones of the partitions, the modular display structure having the complementary ones of the additional engaging members that engage with the further engaging members on at least one of the column and the holders, a base and a cover having further complementary engagement members that engage each other, the base and the cover cooperating with each other to define a cavity bounded by the base and the cover, the cover having at least a portion that is transparent, the cover having a closed front, an open rear, and sidewalls, the open rear having an edge periphery that defines a larger areal dimension than is defined by an edge periphery of the closed front, the base having an open front, a closed rear, and sidewalls, the open front having an edge periphery that defines a larger areal dimension than is defined by an edge periphery of the closed rear.

19. A display structure as in claim 18, wherein the further complementary engagement members include hinged connections that allow the cover to swing about the hinged connections from an open position that is disengaged from the base to a closed position that is engaged with the base.

20. A display structure as in claim 18, further comprising an upright sign holder within one of the base and the cover and secured to same.

21. A display structure as in claim 18, wherein the cover is completely transparent.

22. A display structure as in claim 18, wherein the top of the base has a recess, the top of the cover having a projection that fits into the recess in a complementary manner, the projection being transparent.

23. A display structure as in claim 18, wherein the closed rear of the base has the complementary ones of the additional engaging members configured to effect engagement and snap into place with the further engaging members.

24. A display structure as in claim 18, wherein the sidewalls of the base converge from the open front to the closed rear.

25. A display structure as in claim 18, wherein the sidewalls of the cover converge from the open rear to the closed front.

26. A display structure as in claim 18, wherein the cover converges from the open rear to the closed front.

27. A display structure as in claim 10, wherein the column has an end shape, each of the holders having a walled structure that defines a configuration conforming to said end shape.

* * * * *